US012108898B1

(12) United States Patent
Musselwhite

(10) Patent No.: US 12,108,898 B1
(45) Date of Patent: Oct. 8, 2024

(54) COUPLED SHEET SET

(71) Applicant: Millicent Musselwhite, Blue Ridge, GA (US)

(72) Inventor: Millicent Musselwhite, Blue Ridge, GA (US)

( * ) Notice: Subject to any disclaimer, the term of this patent is extended or adjusted under 35 U.S.C. 154(b) by 0 days.

(21) Appl. No.: 18/409,313

(22) Filed: Jan. 10, 2024

(51) Int. Cl.
*A47G 9/02* (2006.01)
*A47C 21/02* (2006.01)

(52) U.S. Cl.
CPC ..... *A47G 9/0246* (2013.01); *A47C 21/022* (2013.01)

(58) Field of Classification Search
CPC ..... A47C 21/02; A47C 21/022; A47C 21/028; A47G 9/0238; A47G 9/0246; A47G 9/04
See application file for complete search history.

(56) References Cited

U.S. PATENT DOCUMENTS 5,230,111 A * 7/1993 Davis ..... A47G 9/0246 5/497
5,729,847 A * 3/1998 Allardice ..... A47G 9/02 5/500
11,910,945 B1 * 2/2024 Connolly ..... A47G 9/0246
2004/0187211 A1 * 9/2004 Wootten, Jr. ..... A47G 9/0207 5/497
2007/0113341 A1 * 5/2007 Ho ..... A47G 9/0238 5/497
2008/0115271 A1 * 5/2008 Wiley ..... A47G 9/02 5/482
2011/0061165 A1 * 3/2011 Falconetti ..... A47G 9/0246 112/475.01
2012/0233776 A1 * 9/2012 Agarwall ..... A47C 31/105 5/496
2014/0013510 A1 * 1/2014 Mcaleney ..... A47G 9/02 5/495
2016/0022051 A1 * 1/2016 Ebert ..... A47C 31/105 156/60
2016/0058214 A1 * 3/2016 Preston ..... A47G 9/0238 5/497
2016/0157641 A1 * 6/2016 Mendonca-Cali ... A47G 9/0246 5/489
2017/0156517 A1 * 6/2017 Rivera-Huerta ..... A47G 9/0292
2018/0192795 A1 * 7/2018 Pacquette ..... A47G 9/0292
2019/0082866 A1 3/2019 Merchant
2020/0288887 A1 9/2020 Marrero
2021/0378423 A1 * 12/2021 Weinhoffer ..... A47G 9/0223
2022/0151393 A1 5/2022 Maurer
2022/0369825 A1 11/2022 Groppel
2023/0013670 A1 1/2023 Pfister

OTHER PUBLICATIONS

"The Future of Sheets", *Bed Simply Made,* (2024), https://bedsimplymade.com/.
"Connected Bed Sheets Made from Luxury Bamboo Viscose", *Sova,* (2024), https://sleepsova.com/.
"CleverFit Connected Bed Sheets-Aslan Mattress", *Aslan,* (2024), https://www.aslanmattress.com/products/clever-fit-connected-bed-sheets.

* cited by examiner

*Primary Examiner* — Eric J Kurilla
(74) *Attorney, Agent, or Firm* — Alston & Bird LLP

(57) ABSTRACT

In various aspects, a sheet set includes a fitted sheet and a top sheet. The fitted sheet may include four cup portions, each cup portion can be configured to be positioned over four different corners of a mattress. The top sheet may be sewn onto the fitted sheet. The areas as to which the top sheet is sewn onto the fitted sheet may define a seamline. The seamline may extend from a top of one cup portion of the fitted sheet to a top of another cup portion of the fitted sheet.

9 Claims, 4 Drawing Sheets

COUPLED SHEET SET

TECHNICAL FIELD

The present application relates generally to a sheet set. More specifically, the present application relates to a coupled sheet set.

BACKGROUND

Sheet sets often include a fitted sheet that is separate from a top sheet. To install the sheet set onto a bed, the fitted sheet is spread out and then the corners of the fitted sheet are fit around the corners of a mattress. The top sheet is then placed over the fitted sheet and the foot end of the top sheet is positioned between the mattress and a support structure, such as a box spring, by lifting the mattress and tucking the top sheet between the mattress and the support structure. Often, to enhance the appearance of the bed or additionally secure the top sheet, additional steps to create a "hospital corner" may be performed. Making a bed with traditional sheet sets can be time consuming and is often difficult.

The inventor has identified numerous deficiencies and problems with the existing technologies in this field. Through applied effort, ingenuity, and innovation, many of these identified deficiencies and problems have been solved by developing solutions that are structured in accordance with the embodiments of the present disclosure, many examples of which are described in detail herein.

BRIEF SUMMARY

In general, embodiments of the present disclosure provided herein include improved sheet sets. More specifically, the present disclosure includes example embodiments of a sheet set that includes a top sheet that is coupled to a fitted sheet.

In various aspects, a sheet set includes a fitted sheet comprising four cup portions, each cup portion configured to be positioned over four different corners of a mattress, and a top sheet sewn onto the fitted sheet. The areas as to which the top sheet is sewn onto the fitted sheet may define a seamline. The seamline may extend from a top of one cup portion of the fitted sheet to a top of another cup portion of the fitted sheet.

In various examples, the seamline is positioned at a foot end of the fitted sheet.

In various examples, the top sheet is only sewn onto the fitted sheet at the seamline and the seamline only extends in a transverse direction.

In various examples, the seamline extends a distance that is within one inch of a width of the mattress.

In various examples, the top sheet comprises a double hem that defines a width, wherein the width is at least two inches and up eight inches.

In various examples, the width of the double hem is at least four inches and up to six inches.

In various examples, the top sheet or the fitted sheet comprises at least one fastener and the other of the top sheet or the fitted sheet comprises at least one coupling feature. Each fastener may be configured to be coupled with a corresponding coupling feature.

In various examples, each fastener is a button, and each coupling feature is a buttonhole.

In various examples, each fastener is positioned on or proximate to a respective cup portion of the fitted sheet.

In various aspects a sheet set includes a fitted sheet that has four cup portions. Each cup portion may be to be positioned over four different corners of a mattress. The sheet set may include a top sheet sewn onto the fitted sheet. The areas as to which the top sheet is sewn onto the fitted sheet may define a seamline. The seamline may extend from a top of one cup portion of the fitted sheet to a top of another cup portion of the fitted sheet, the seamline may be positioned at a foot end of the fitted sheet, the top sheet may be only sewn onto the fitted sheet at the seamline and the seamline only extends in a transverse direction, and the seamline may extend a distance that is within one inch of a width of the mattress.

In various examples, the top sheet includes a double hem that defines a width. The width may be at least two inches and up eight inches.

In various examples, the width of the double hem is at least four inches and up to six inches.

In various examples, the sheet set includes a button positioned proximate to the top of the one cup portion of the fitted sheet.

In various examples, the top sheet or the fitted sheet comprises at least one button and the other of the top sheet or the fitted sheet comprises at least one buttonhole. Each button may be configured to be coupled with a corresponding buttonhole.

In various examples, each button is positioned on or proximate to a respective cup portion of the fitted sheet.

In various aspects, a sheet set includes a fitted sheet that has four cup portions, each cup portion configured to be positioned over four different corners of a mattress. The sheet set may include a top sheet sewn onto the fitted sheet. The areas as to which the top sheet is sewn onto the fitted sheet may define a seamline. The seamline may extend from a top of one cup portion of the fitted sheet to a top of another cup portion of the fitted sheet, the seamline may be positioned at a foot end of the fitted sheet, the top sheet may be only sewn onto the fitted sheet at the seamline and the seamline only extends in a transverse direction, and the seamline may extend a distance that is within one inch of a width of the mattress. The top sheet or the fitted sheet may include at least one fastener and the other of the top sheet or the fitted sheet comprises at least one coupling feature. Each fastener may be configured to be coupled with a corresponding coupling feature.

In various examples, each fastener is a button and each coupling feature is a buttonhole.

In various examples, each fastener or each coupling feature is positioned on or proximate to a respective cup portion of the fitted sheet.

In various examples, each fastener or each coupling feature is positioned within three inches of a top portion of a respective cup portion of the fitted sheet.

In various examples, each fastener is a button.

The above summary is provided merely for purposes of summarizing some example embodiments to provide a basic understanding of some aspects of the present disclosure. Accordingly, it will be appreciated that the above-described embodiments are merely examples and should not be construed to narrow the scope or spirit of the present disclosure in any way. It will be appreciated that the scope of the present disclosure encompasses many potential embodiments in addition to those here summarized, some of which will be further described below. Other features, aspects, and advantages of the subject matter will become apparent from the description, the drawings, and the claims.

BRIEF DESCRIPTION OF THE DRAWINGS

Figure 1:
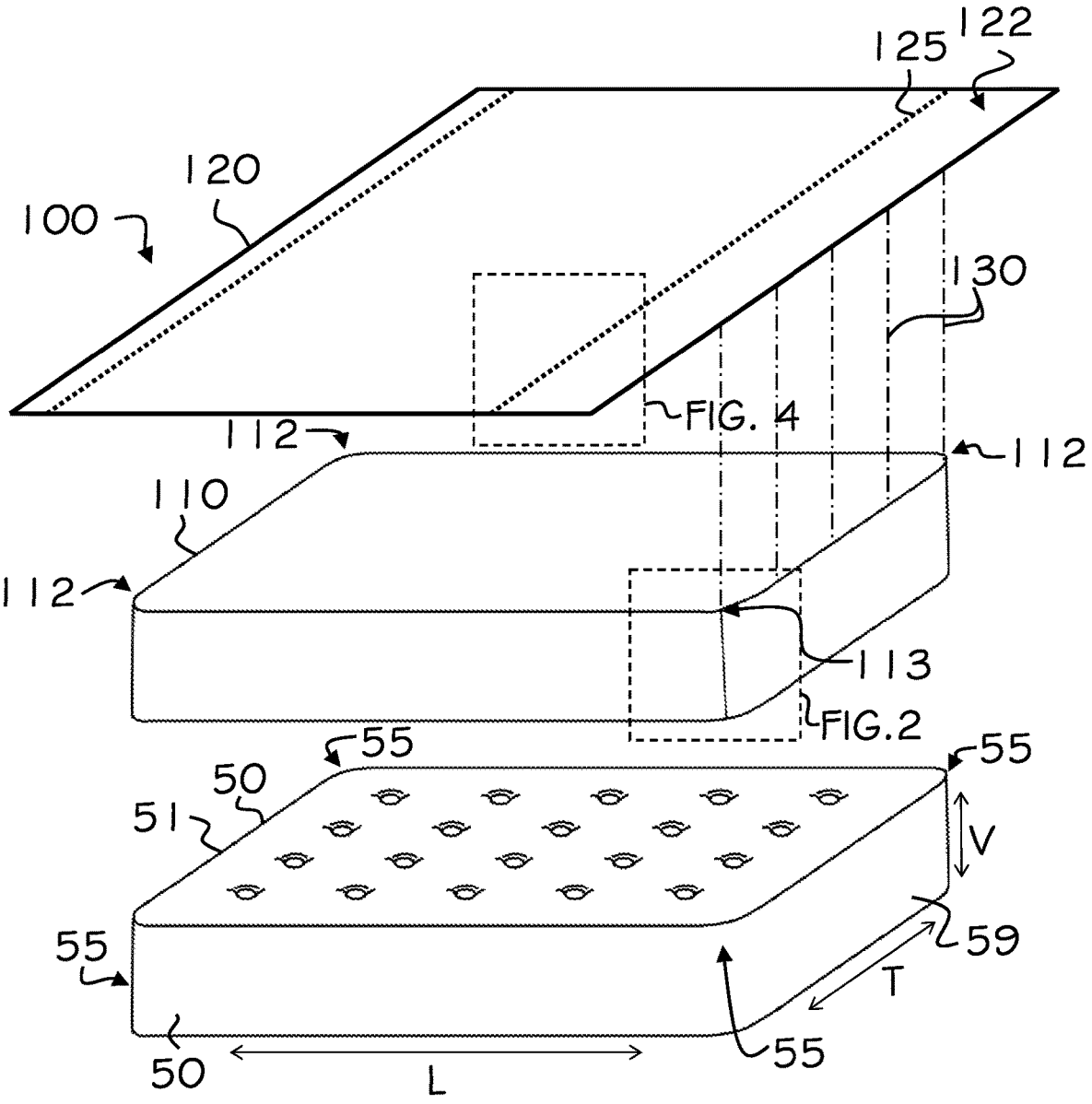

Having thus described certain example embodiments of the present disclosure in general terms above, non-limiting and non-exhaustive embodiments of the subject disclosure are described with reference to the following figures, which are not necessarily drawn to scale and wherein like reference numerals refer to like parts throughout the various views unless otherwise specified. The components illustrated in the figures may or may not be present in certain embodiments described herein. Some embodiments may include fewer (or more) components than those shown in the figures.

FIG. 1 provides an isometric, exploded view of a sheet set, in accordance with an example embodiment.

Figure 2:
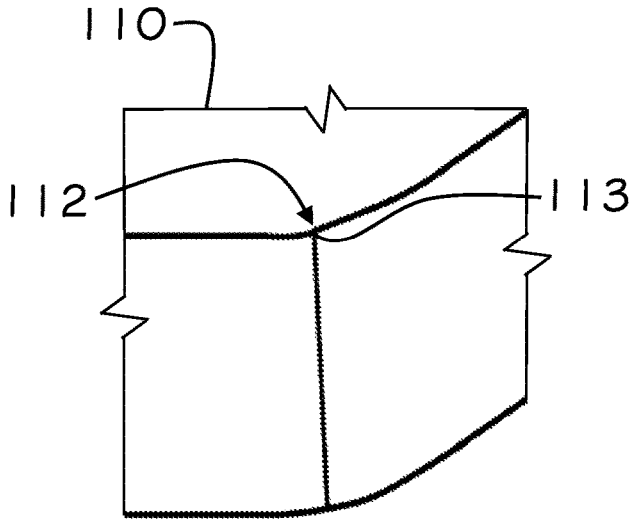

FIG. 2 provides a close-up view of a fitted sheet of the sheet set of FIG. 1, in accordance with an example embodiment.

Figure 3:
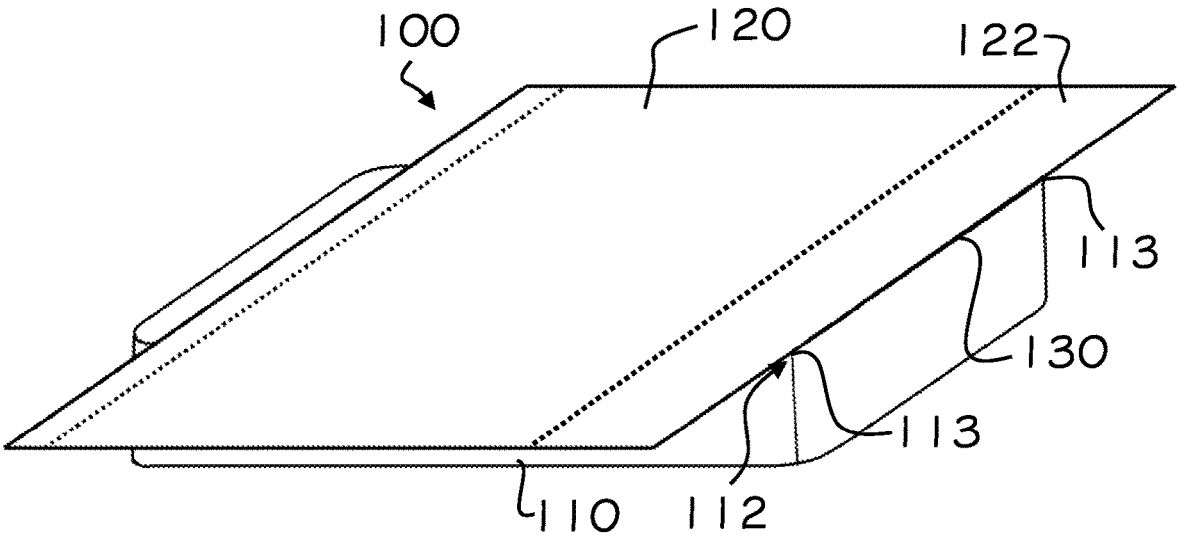

FIG. 3 provides an isometric, schematic view of the sheet set of FIG. 1, in accordance with an example embodiment.

Figure 4:
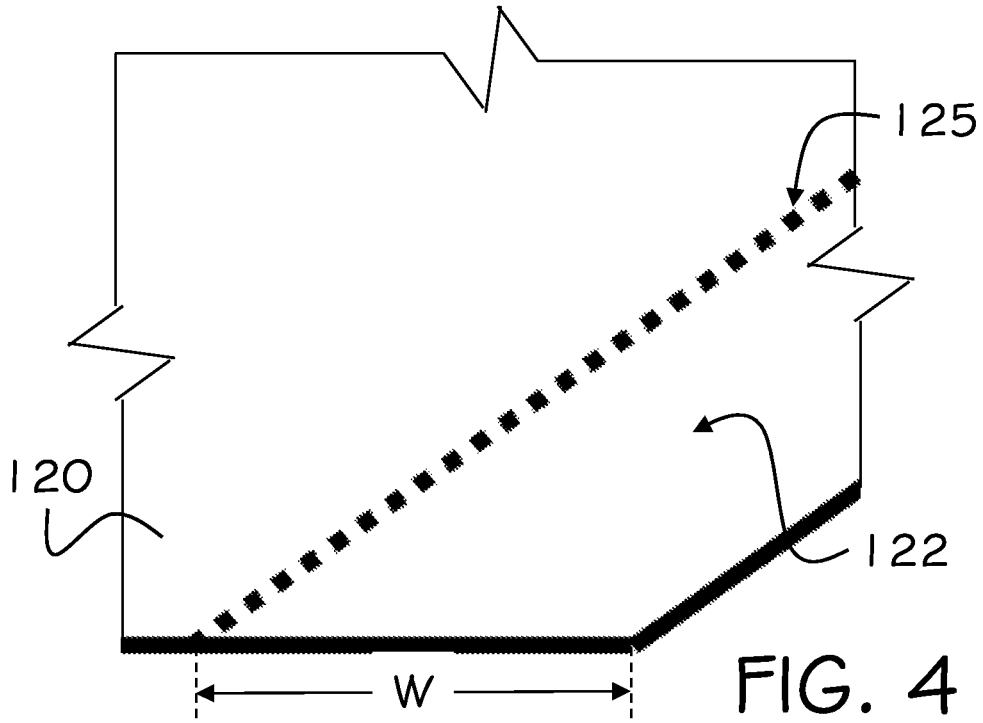

FIG. 4 provides a close-up view of a top sheet of the sheet set of FIG. 1, in accordance with an example embodiment.

Figure 5:
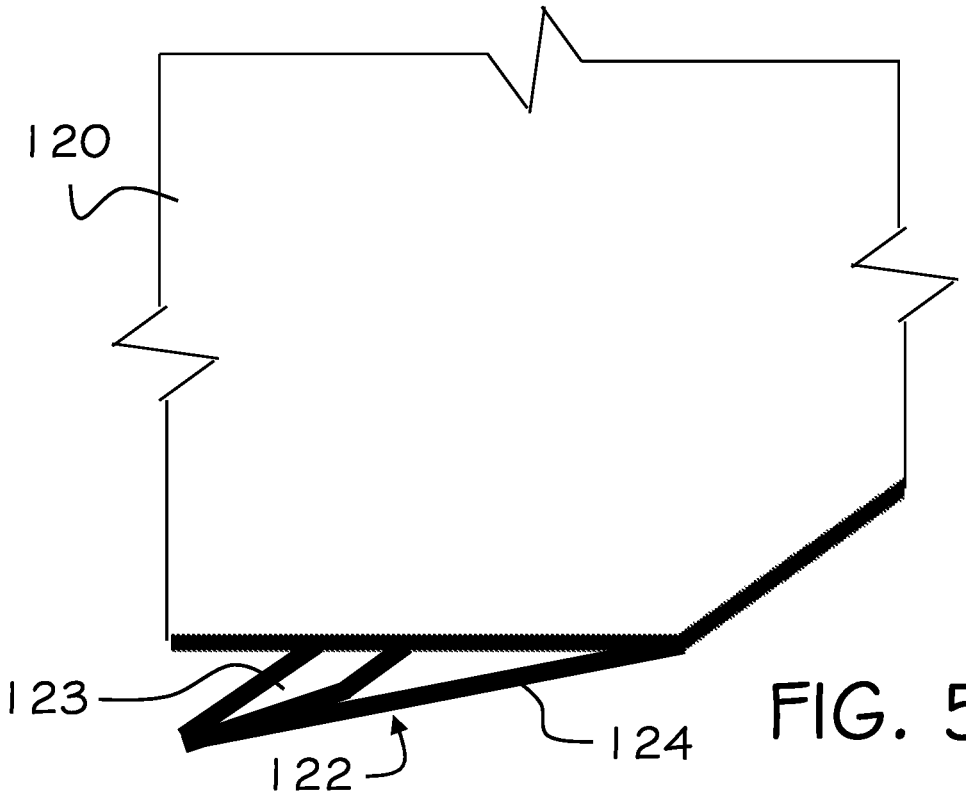

FIG. 5 provides a close-up view of the top sheet of FIG. 4 during a manufacturing process, in accordance with an example embodiment.

Figure 6:
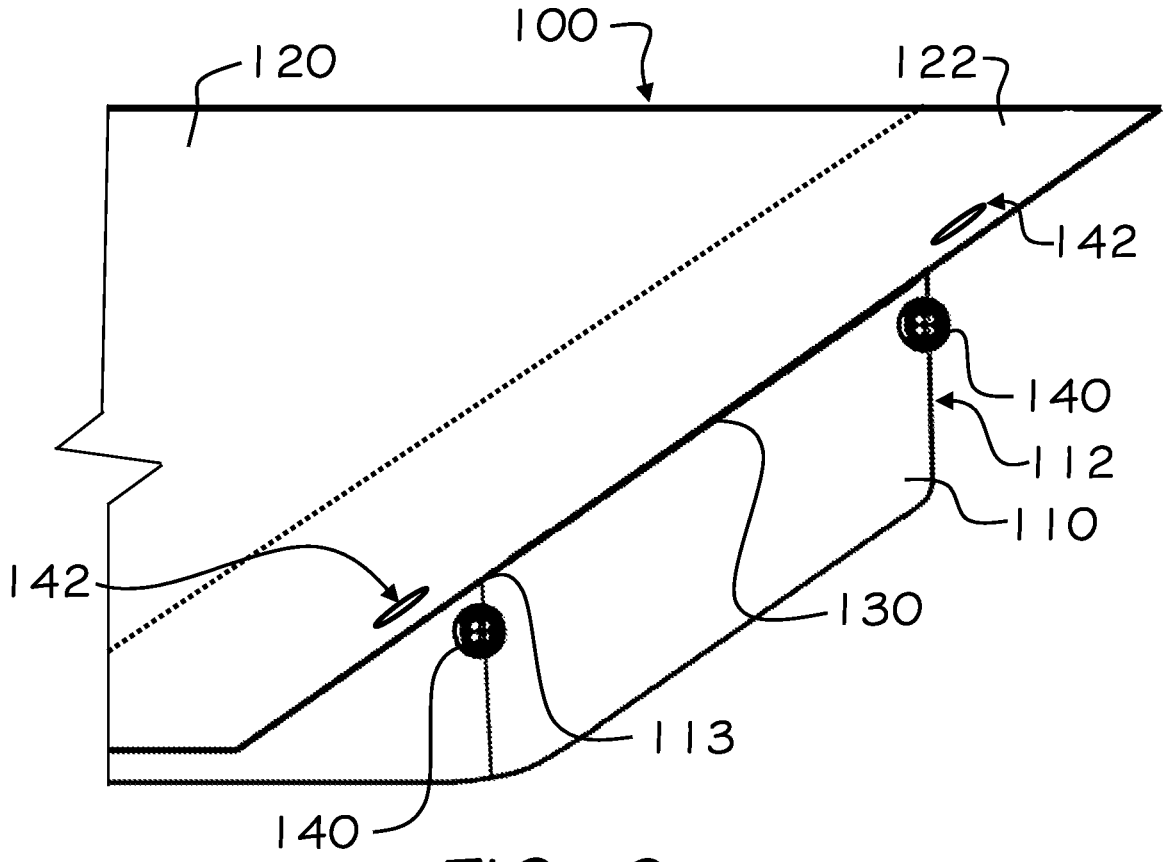

FIG. 6 provides a view of a portion of a sheet set, in accordance with an example embodiment.

DETAILED DESCRIPTION

One or more embodiments are now more fully described with reference to the accompanying drawings, wherein like reference numerals are used to refer to like elements throughout and in which some, but not all embodiments of the inventions are shown. In the following description, for purposes of explanation, numerous specific details are set forth in order to provide a thorough understanding of the various embodiments. It is evident, however, that the various embodiments can be practiced without these specific details. It should be understood that some, but not all embodiments are shown and described herein. Indeed, the embodiments may be embodied in many different forms, and accordingly this disclosure should not be construed as limited to the embodiments set forth herein. Rather, these embodiments are provided so that this disclosure will satisfy applicable legal requirements.

As used herein, the term "exemplary" means serving as an example, instance, or illustration. Any aspect or design described herein as "exemplary" is not necessarily to be construed as preferred or advantageous over other aspects or designs. Rather, use of the word exemplary is intended to present concepts in a concrete fashion. In addition, while a particular feature may be disclosed with respect to only one of several implementations, such feature may be combined with one or more other features of the other implementations as may be desired and advantageous for any given or particular application. Furthermore, to the extent that the terms "includes" and "including" and variants thereof are used in either the detailed description or the claims, these terms are intended to be inclusive in a manner similar to the term "comprising."

As used herein, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the terms "coupled," "fixed," "attached to," and the like refer to both direct coupling, fixing, or attaching, as well as indirect coupling, fixing, or attaching through one or more intermediate components or features, unless otherwise specified herein.

As used herein, the term "proximate to," "near," or the like, refers to a first component being positioned within three inches, such as within two inches, such as within 1 inch of the other component or area specified.

As used herein, terms of approximation, such as "approximately," "substantially," or "about," refer to being within manufacturing or engineering tolerances. For example, terms of approximation may refer to being within a five percent margin of error.

Referring now to FIGS. 1-3, various views of a sheet set 100 are provided, in accordance with an example embodiment. The sheet set 100 may include a fitted sheet 110 and a top sheet 120. The top sheet 120 may be sewn onto the fitted sheet 110. FIG. 1 provides an isometric, exploded view of the sheet set 100, FIG. 2 provides a close-up view of the fitted sheet 110, and FIG. 3 provides an isometric, schematic view of the sheet set 100.

In various examples, the sheet set 100 is configured to be positioned on a mattress 50 of a bed. For example, the fitted sheet 110 of the sheet set 100 may include four cup portions 112. Each cup portion 112 of the fitted sheet 110 may be configured to be positioned over four different corners 55 of a mattress 50. The mattress 50 may be of any size. For example, the mattress 50 may be twin size (i.e., 39 inches wide by 75 inches long), full size (i.e., 54 inches wide by 75 inches long), queen size (i.e., 60 inches wide by 80 inches long), king size (76 inches wide by 80 inches long), or California king size (72 inches wide by 84 inches long). The mattress 50 may define a longitudinal direction L, a transverse direction T, and a vertical direction V when the mattress is in an operational position. The mattress 50 may define a head end 51 and a foot end 59.

The fitted sheet 110 and the top sheet 120 of the sheet set 100 may be manufactured from a fabric that comprises cotton, bamboo, polyester, linen, lyocell, modal, silk, microfiber, satin, or a combination thereof. In various examples, the fitted sheet 110 and the top sheet 120 are manufactured from the same fabric. In various other examples, the fitted sheet 110 and the top sheet 120 are manufactured from different fabrics.

In various examples, the top sheet 120 may be coupled to the fitted sheet 110. For example, the top sheet 120 may be sewn onto the fitted sheet 110. The areas as to which the top sheet 120 is coupled to, such as sewn onto, the fitted sheet 110 may define a seamline 130 (schematically depicted as vertical dashed lines in the exploded view of FIG. 1). The seamline 130 may extend from a top 113 of one cup portion 112 of the fitted sheet 110 to a top 113 of another cup portion 112 of the fitted sheet 110. The seamline 130 may be positioned at the foot end of the fitted sheet 110. In various examples, the seamline 130 may extend a distance that is approximately the same distance of the width of the mattress 50 for which the fitted sheet 110 is configured to fit. For example, the seamline 130 may extend a distance that is within two inches, such as within one inch of the width of the mattress 50.

In various examples, the top sheet 120 is only sewn onto the fitted sheet 110 at the seamline 130 and the seamline 130 extends only in the transverse direction defined by the mattress 50 for which the fitted sheet 110 is configured to fit. As such, the top sheet 120 is not sewn onto the fitted sheet 110 in the longitudinal direction L defined by the mattress 50. Therefore, the sides of the top sheet 120 are able to freely move relative to the fitted sheet 110. Allowing the sides of the top sheet 120 to freely move relative to the fitted sheet 110 has various benefits. For example, this configuration may increase the comfort of a user of the mattress 50 that the sheet set 100 is installed on because the user may not feel as restrained when positioned between the fitted sheet 110 and the top sheet 120 of the sheet set 100.

Referring now to FIGS. 4 and 5, a close-up view of a top sheet 120 (FIG. 4) and a close-up view of the top sheet 120 during a manufacturing process (FIG. 5) are provided, in accordance with an example embodiment. In various examples, the top sheet 120 comprises a double hem 122. The double hem 122 may define a width W that is at least two inches and up to eight inches, such as at least four inches and up to six inches. The top sheet 120 may be folded twice to create the double hem 122. For example, the top sheet 120 may be folded once, creating the first fold 123, and then again, creating the second fold 124. Then, the portions defined by the first fold 123 and the second fold 124 may be sewn onto the upper portion of the top sheet 120, creating a double hem seam 125.

Providing a double hem 122 has various benefits. For example, the double hem 122 may shorten a length of an off-the-shelf top sheet to optimize the length of the top sheet 120. For example, off-the-shelf top sheets are often longer than the length of the bed by at least 20 inches and up to 36 inches, depending on the size of the bed. As such, when the top sheet 120 is an off-the-shelf top sheet 120, the top sheet 120 may be too long once sewn onto the fitted sheet 110. As such, providing a double hem 122 may shorten the length of the top sheet 120 to a more appropriate length to be installed within the sheet set 100. Additionally, providing the double hem 122 may provide additional warmth near the foot end 59, which may be desirable to a user utilizing the sheet set 100.

Referring now to FIG. 6, a view of a portion of a sheet set 100 is provided, in accordance with an example embodiment. In various examples, the sheet set 100 includes at least one fastener 140. For example, the sheet set 100 may include at least one fastener 140 that is positioned on or proximate to a cup portion 112 of the fitted sheet 110 and another fastener 140 can be positioned on or proximate to another cup portion 112 of the fitted sheet 110. In various examples, each fastener is positioned proximate to a foot end of the fitted sheet 110. Each fastener 140 may be positioned proximate to (e.g., within three inches of) a top 113 portion of a cup portion 112 of the fitted sheet 110. In various examples, each fastener 140 is configured as a button. In various examples, each fastener 140 may be coupled to the fabric of the sheet set 100 with thread.

The fastener 140 may be configured to couple the top sheet 120 to the fitted sheet 110. In various examples, a corresponding coupling feature 142 may be positioned on the top sheet 120 and may be configured to couple to the fastener 140. For example, and as depicted, the fastener 140 may be configured as a button and the coupling feature 142 may be configured as a buttonhole. The button may be configured to be positioned within the buttonhole to further couple the top sheet 120 to the fitted sheet 110. In various examples, the top sheet 120 comprises the fastener 140 and the fitted sheet 110 comprises the corresponding coupling feature 142.

In various examples, the top sheet 120 is sewn onto the fitted sheet 110 and the fastener 140 is provided to provide additional coupling of the top sheet 120 to the fitted sheet 110. For example, once the sheet set 100 is installed on a mattress 50, the sides of the top sheet 120 may fall downward and be positioned vertically. The portion of the top sheet 120 that falls downward may be coupled to the fitted sheet with the fastener and the corresponding coupling feature 142. Coupling the portion of the top sheet 120 that falls downward to the fitted sheet has various benefits. For example, this configuration may improve the aesthetics of the sheet set 100.

The sheet set 100 of the present disclosure has various additional benefits not already discussed. For example, the sheet set 100 of the present disclosure may be quicker and easier to install on a mattress 50 than traditional sheet sets. Traditional sheet sets often require a user to lift up the mattress 50 and then tuck the top sheet 120 under the mattress 50. Additionally, a user may also desire to perform additional steps, such as creating a "hospital corner" prior to tucking the top sheet 120 under the mattress 50. This lifting and tucking process may be challenging for some users and may also be time consuming. Additionally, the likelihood of a traditional top sheet becoming untucked when the traditional sheet set is in use is high. However, the sheet set 100 of the present disclosure decreases these issues because there is no need for the top sheet 120 to be tucked under the foot end 59 of the mattress 50.

Conclusion

The above descriptions of various embodiments of the subject disclosure and corresponding figures and what is described in the Abstract, are described herein for illustrative purposes, and are not intended to be exhaustive or to limit the disclosed embodiments to the precise forms disclosed. It is to be understood that one of ordinary skill in the art may recognize that other embodiments having modifications, permutations, combinations, and additions can be implemented for performing the same, similar, alternative, or substitute functions of the disclosed subject matter, and are therefore considered within the scope of this disclosure. Therefore, the disclosed subject matter should not be limited to any single embodiment described herein, but rather should be construed in breadth and scope in accordance with the appended claims below. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A sheet set for a bed, the sheet set comprising:

a fitted sheet comprising four cup portions, each cup portion configured to be positioned over four different corners of a mattress; and a top sheet sewn onto the fitted sheet, wherein the areas as to which the top sheet is sewn onto the fitted sheet define a seamline, wherein:

the seamline extends from a top of one cup portion of the fitted sheet to a top of another cup portion of the fitted sheet, the seamline is positioned at a foot end of the fitted sheet, the top sheet is only sewn onto the fitted sheet at the seamline and the seamline only extends in a transverse direction, the seamline extends a distance that is within one inch of a width of the mattress, the top sheet or the fitted sheet comprises at least one fastener and the other of the top sheet or the fitted sheet comprises at least one coupling feature, each fastener is configured to be coupled with a corresponding coupling feature, each fastener is positioned on a cup portion and within three inches of a top portion of the cup portion, the top sheet comprises a double hem that defines a width, the width of the double hem is at least two inches and up to eight inches, and the double hem is positioned proximate to the foot end.

2. The sheet set of claim 1, wherein each fastener is a button and each coupling feature is a buttonhole.

3. The sheet set of claim 1, wherein each fastener is a button.

4. The sheet set of claim 1, wherein the double hem comprises a first fold, wherein the first fold is positioned under an upper portion of the top sheet.

5. The sheet set of claim 1, wherein the width of the double hem is at least four inches and up to six inches.

6. The sheet set of claim 1, wherein:

each fastener is a button and each coupling feature is a buttonhole; and the double hem comprises a first fold, wherein the first fold is positioned under an upper portion of the top sheet.

7. The sheet set of claim 1, wherein:

each fastener is a button and each coupling feature is a buttonhole; and the width of the double hem is at least four inches and up to six inches.

8. The sheet set of claim 1, wherein:

the double hem comprises a first fold, wherein the first fold is positioned under an upper portion of the top sheet; and the width of the double hem is at least four inches and up to six inches.

9. The sheet set of claim 1, wherein:

each fastener is a button and each coupling feature is a buttonhole;

the double hem comprises a first fold, wherein the first fold is positioned under an upper portion of the top sheet; and the width of the double hem is at least four inches and up to six inches.

* * * * *